US009669531B2

(12) United States Patent
Gensmann

(10) Patent No.: US 9,669,531 B2
(45) Date of Patent: Jun. 6, 2017

(54) HAMMER DRILL

(71) Applicant: Black & Decker Inc., Newark, DE (US)

(72) Inventor: Stefan Gensmann, Frucht (DE)

(73) Assignee: Black & Decker Inc., New Britain, CT (US)

( * ) Notice: Subject to any disclaimer, the term of this patent is extended or adjusted under 35 U.S.C. 154(b) by 873 days.

(21) Appl. No.: 14/026,621

(22) Filed: Sep. 13, 2013

(65) Prior Publication Data

US 2014/0083727 A1 Mar. 27, 2014

(30) Foreign Application Priority Data

Sep. 21, 2012 (GB) ..... 1216905.8

(51) Int. Cl.

| | |
|---|---|
| ***B25D 11/06*** | (2006.01) |
| ***B25D 9/16*** | (2006.01) |
| ***B25D 9/26*** | (2006.01) |
| ***B25D 11/12*** | (2006.01) |
| ***B25D 11/00*** | (2006.01) |

(52) U.S. Cl.

CPC ..... *B25D 9/26* (2013.01); *B25D 9/16* (2013.01); *B25D 11/005* (2013.01); *B25D 11/125* (2013.01); *B25D 2250/035* (2013.01); *B25D 2250/195* (2013.01); *B25D 2250/221* (2013.01); *B25D 2250/231* (2013.01)

(58) Field of Classification Search

CPC ..... B25D 11/06; B25D 11/005; B25D 9/16
USPC ..... 173/201
See application file for complete search history.

(56) References Cited

U.S. PATENT DOCUMENTS

| | | | | |
|---|---|---|---|---|
| 1,402,727 A * | 1/1922 | Seaboldt | B25D 11/06 173/14 |
| 5,111,890 A * | 5/1992 | Ranger | B25D 11/005 173/104 |
| 5,435,397 A * | 7/1995 | Demuth | B25D 11/005 173/109 |

(Continued)

FOREIGN PATENT DOCUMENTS

| | | |
|---|---|---|
| DE | 1652685 | 12/1970 |
| DE | 3932134 | 4/1991 |

(Continued)

*Primary Examiner* — Andrew M Tecco
*Assistant Examiner* — Praachi M Pathak
(74) *Attorney, Agent, or Firm* — Amir R. Rohani

(57) ABSTRACT

A hammer drill having a motor mounted within a body and an output spindle; a tool holder mounted on the body capable of holding a cutting tool; a hammer mechanism having a piston; a reciprocating drive for converting rotary movement of the motor into reciprocating movement of the piston; a ram reciprocatingly driven by the piston via an air spring to strike a cutting tool held in the tool holder, the hammer mechanism performing one hammer cycle each time the ram strikes a cutting tool during normal use; an air replenishment mechanism capable of refreshing the air spring during certain time periods during normal use; the air replenishment mechanism capable of being adjusted to refresh the air spring during time periods within the hammer cycle and/or the system allows different volumes of air into or out of the air spring during the refreshment time periods.

15 Claims, 11 Drawing Sheets

(56) References Cited

U.S. PATENT DOCUMENTS

| | | | | |
|---|---|---|---|---|
| 5,775,440 | A * | 7/1998 | Shinma | B25D 11/005 173/109 |
| 5,873,418 | A * | 2/1999 | Arakawa | B25D 11/005 173/109 |
| 7,306,048 | B2 * | 12/2007 | Yamazaki | B25D 11/005 173/212 |
| 2003/0094292 | A1 * | 5/2003 | Haga | B25D 16/00 173/48 |
| 2006/0124333 | A1 * | 6/2006 | Berger | B25D 11/005 173/201 |
| 2008/0006425 | A1 * | 1/2008 | Berghauser | B25D 17/24 173/201 |
| 2008/0073096 | A1 | 3/2008 | Berger | |
| 2014/0083727 | A1 * | 3/2014 | Gensmann | B25D 11/125 173/1 |

FOREIGN PATENT DOCUMENTS

| | | |
|---|---|---|
| EP | 1607186 | 12/2005 |
| EP | 2500141 | 9/2012 |
| GB | 2145959 | 4/1985 |
| GB | 2394438 | 4/2004 |

* cited by examiner

HAMMER DRILL

CROSS-REFERENCE TO RELATED APPLICATIONS

This application claims priority, under 35 U.S.C. §119 (a)-(d), to UK Patent Application No. GB 1216905.8 filed Sep. 21, 2012, the contents of which are incorporated herein by reference in its entirety.

FIELD OF THE INVENTION

The present application relates to a hammer drill having a cylinder, in which is located a piston and a ram, the reciprocating movement of the piston reciprocatingly driving the ram via an air spring to impart impacts to a cutting tool.

BACKGROUND OF THE INVENTION

A pavement breaker is a type of hammer drill which operates in a hammer only mode. However, other types of hammer drill operate in two modes, namely a hammer only mode or a hammer and drill mode, or in three modes of operation, namely a hammer only mode, a hammer and drill mode or a drill only mode.

EP1872913 discloses an example of a pavement breaker which comprises a cylinder in which is mounted a piston which is reciprocatingly driven by a motor via a hammer mechanism. The piston in turn reciprocatingly drives a ram which imparts impacts onto a cutting tool via a beat piece. The cylinder comprises a single bleed hole to refresh the air spring. The characteristics of the performance of the pavement breaker vary depending on the hardness of the material being cut. The problem with this design is that the characteristics of the performance of the hammer can not be adjusted.

BRIEF SUMMARY OF THE INVENTION

According to a first aspect of the present invention, there is provided a hammer drill according to claim 1.

The normal use of the hammer drill is when the hammer drill is running continuously whilst working on a work piece.

According to a second aspect of the present invention, there is provided a method of altering the performance characteristics of a hammer according to claim 17.

BRIEF DESCRIPTION OF THE DRAWINGS

Four embodiments will now be described with reference to the following figures of which.

DETAILED DESCRIPTION OF THE INVENTION

Figure 1:
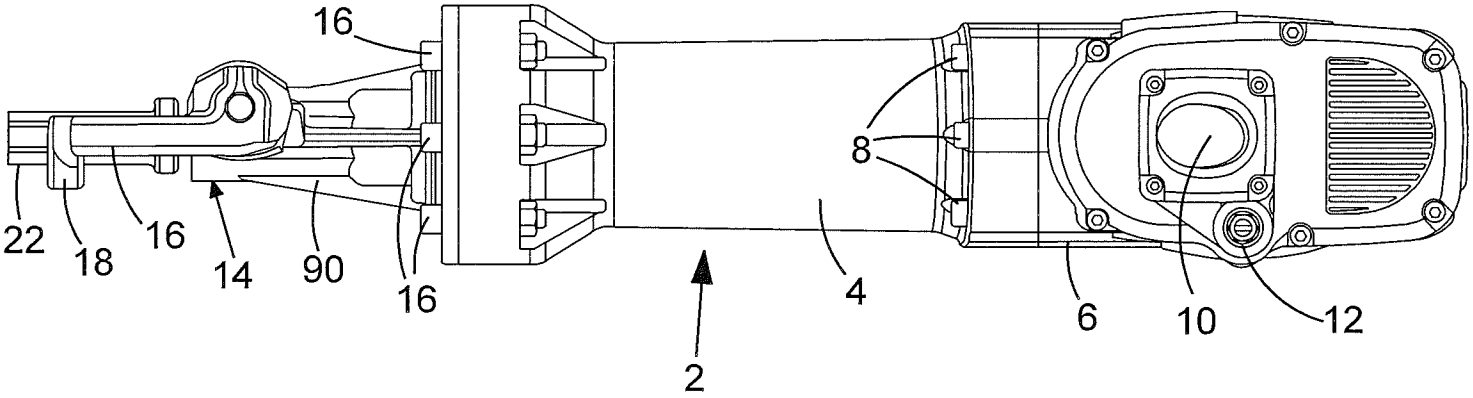
FIG. 1 shows a side view of a pavement breaker.

Referring to FIG. 1, the pavement breaker comprises a body 2 comprising a middle housing 4 connected to an upper housing 6 using bolts 8. Two handles 10 are moveably mounted on the upper housing via a vibration dampening mechanism 12. A tool holder 14 is attached to the opposite end of the middle housing to that of the upper housing 6 using bolts 16. The tool holder 14 comprises a body 90, a pivotal clamp 16 having a U shaped bracket 18 which holds a cutting tool 22, such as a chisel, when the pivotal clamp 16 is pivoted to the position shown in FIG. 1. The design of such pivotal clamps is well known in the art and therefore will not be described in any further detail.

Figure 2:
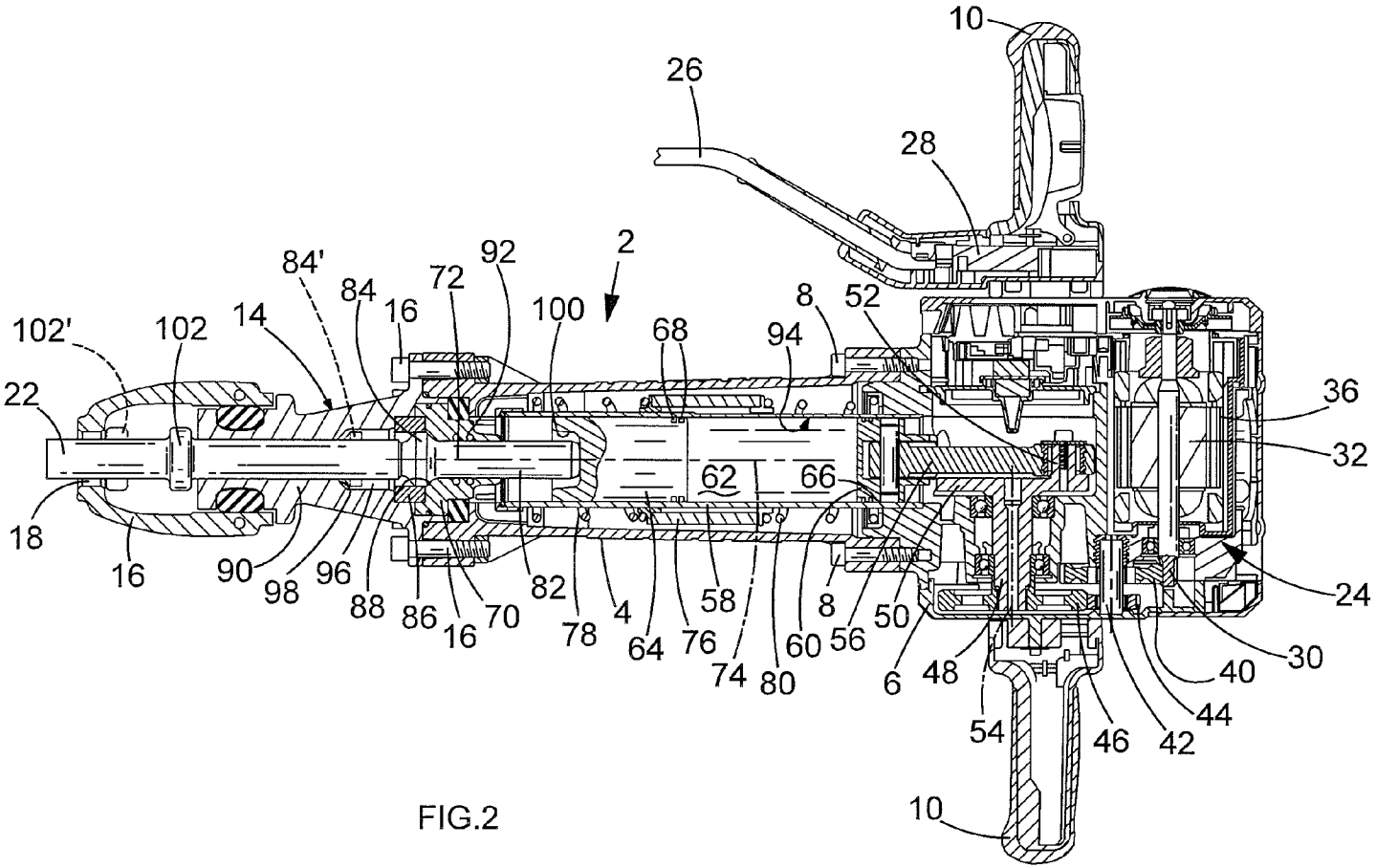
FIG. 2 shows a vertical cross section of a pavement breaker with a bleed hole in a first position.

Referring to FIG. 2, the pavement breaker comprises an electric motor 24 mounted within the upper housing 6. The motor comprises a rotor 32 rotatably mounted within a stator 36 in well known manner. The motor 24 is powered by a mains electricity supply which is provided via an electric cable 26 which connects to the motor 24 via an electric switch 28. When the cable is connected to an electricity supply, operation of the electric switch 28 activated the motor causing the rotor 32 together with an output spindle 30 to rotate.

The output spindle 30 is comprises splines which mesh with the teeth of a first gear 40. The first gear 40 is rigidly mounted on a rotatable shaft 42. A second gear 44 is also rigidly mounted on the rotatable shaft 42. The second gear 44 meshes with a third gear 46 which is rigidly mounted on a rotatable crank shaft 48. The crank shaft 48 comprises a disk 50 formed at one end on which is rigidly mounted an eccentric pin 52. Rotation of the spindle 30 of the motor 24 results in rotation of the crank shaft 48 via the gears, which in turn results in rotation of the eccentric pin 52 around the axis of rotation 54 of the crank shaft 48.

A tubular cylinder 58 is rigidly mounted within housing 2. A piston 60 is slideably mounted within the cylinder 58 and is capable of sliding in a direction parallel to longitudinal axis 74 of the cylinder 58. A con rod 56 is rotationally attached at one end to the eccentric pin 52 via a bearing. The piston 60 is pivotally connected to the other end of the con rod 56. Rotational movement of the eccentric pin 52 around the axis of rotation 54 of the crank shaft 48, results in a reciprocating sliding movement of the piston 60 inside the cylinder in well known manner. Each single rotation of the eccentric pin 52 around the longitudinal axis 54 of the crank shaft 48 results in a single back and forth movement of the piston in the cylinder and is referred to as a hammer cycle. As such, rotation of the spindle 30 results in a reciprocating movement of the piston 60 within the cylinder 58. The piston comprises piston rings 66 which form an air tight seal between the sides of the piston 60 and the inner wall of the cylinder 58.

Located inside of the cylinder 58, forward of the piston 60, is a ram 64. The ram 64 can freely slide within the cylinder 58 in a direction parallel to the longitudinal axis 74 of the cylinder 58. The ram 64 comprises sealing rings 68 which form an air tight seal between the sides of the ram 64 and the inner wall of the cylinder 58. The ram 64 is connected to the piston 60 via an air spring 62 formed inside of the cylinder 58 between the piston 60 and the ram 64. As such, the reciprocating movement of the piston 60, when driven by the motor, is transferred to the ram 64.

A bleed hole 94 is formed through the side wall of the cylinder 58 which enables the air spring to be refreshed. The bleed hole is circular in cross section and has a diameter of 2 mm. The maximum amount by which the piston can slide within the cylinder away from the motor is indicated by L3 which shows the position of the front of the piston at this position. The bleed hole is located 151 rearward of this position by 38 mm so that the piston 60 passes over the bleed hole 94 as it is reciprocatingly driven. As such, the piston 60 repeatedly opens and closes the bleed hole 94 when it is to the rear of the bleed hole 94 or when it is covering the bleed hole 94 respectively. The ram 64 comprises a recess 100 formed in its front end.

Mounted inside of the housing, in front of the cylinder 58, is a beat piece support structure 70. Slideably mounted within the beat piece support structure 70 is a beat piece 72. The beat piece 72 comprises a tubular body 82 with a radially extending flange 84 formed at the front end of the beat piece 72. The beat piece support structure 70 comprises a tubular section 92 which slidingly engages with the sides of the tubular body 82. The beat piece 72 can slide in a direction parallel to the longitudinal axis 74 of the cylinder 58. The rear end of the beat piece projects into the cylinder 58 and is repetitively struck by the base of the recess 100 of the ram 64 when it is reciprocatingly driven by the piston 60 via the air spring 62. This in turn results in the front end of the beat piece repetitively striking the end of the cutting tool 22 when held in the tool holder 14.

A tubular counter mass 76 surrounds the outside of the cylinder 58 and is capable of sliding in a direction parallel to the longitudinal axis 74 of the cylinder 58 along the outside of the cylinder. The tubular counter mass is sandwiched between two helical springs 78, 80 which wrap around the cylinder 58 and which are each held in position at one end by the housing. The counter mass 76 oscillates in response to vibrations in the housing. The weight of the counter mass 76 and the strength of the springs 78, 80 are set to predetermined values so that oscillation of the counter mass 76 counteracts the vibrations in the housing, thus acting as a vibration dampener.

The beat piece support structure 70 abuts against the rear of the tool holder 14. A circular washer 86 is sandwiched between beat piece support structure 70 and the body 90 of the tool holder 14. The circular washer 86 has an inner diameter which is greater than that of the tubular body 82 of the beat piece 72 but the same as that of the periphery of the flange 84, thus forming a inner washer space 87 in which the flange 84 can freely slide inside of the washer 86. A forward facing chamfer 88 is formed on the forward part of the beat piece support structure 70. The chamfer 88 tapers from the inner surface, which faces towards the beat piece 72, of the washer 86 towards the inner wall of the tubular section 92 of the beat piece support structure 70 which slidingly engages the side of the tubular body 82 of the beat piece 72. The body 90 of the tool holder comprises a tubular recess 96 which extends forward from the rear of the body 90 until a rearward facing chamfer 98 formed inside of the body 90. An elongate tubular space formed by the tubular recess 96 of the tool holder 14 and the washer space 87, and which is terminated at one by forward facing chamfer 88 on the beat piece support structure 70 and rearward facing chamfer 98 inside the body 90 of the tool holder 14. The flange 84 of the beat piece 72 can axially slide within the elongate tubular space 96, 87 between a second position where the rear side of the flange 84 abuts the forward facing chamfer 88 on the beat piece support structure 70 and a first position where the forward side of the flange 84 abuts the rearward facing chamfer 98 inside of the body 90 of the tool holder 14.

The cutting tool 22 can axially slide in a direction parallel to the longitudinal axis 74 of the cylinder 58. The cutting tool 22 comprises a rib 102 which limits the range of axial movement of the cutting tool within the tool holder when the pivotal clamp 16 is in the locked position as shown in FIG. 1. The cutting tool 22 can slide between a first position (shown in dashed lines 102' in FIG. 2) where the rib 102' abuts against the U shaped bracket 18 and a second position where the rib 102 abuts against the body 90 of the tool holder as shown in FIG. 2.

Figure 4:
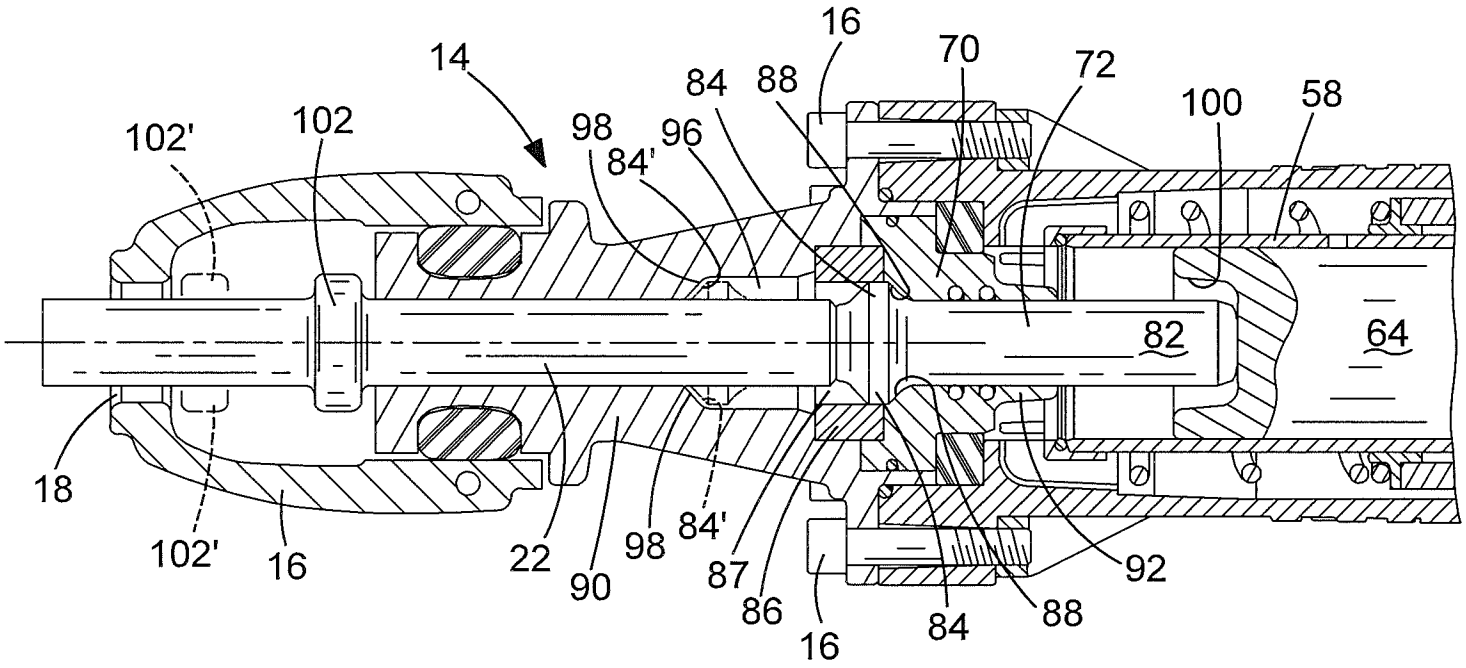
FIG. 4 shows an enlarged view of the tool holder end of the vertical cross section of the pavement breaker with the bleed hole in the first position as shown in FIG. 2.

Referring to FIG. 4 which shows an enlarged view, during use, the working end (not shown) of the cutting tool 22 is place against a work piece to be cut. The ram 64 strikes the beat piece 72 which in turn strikes the end of the cutting tool 22 which strikes the work piece. When the cutting tool 22 is struck by the beat piece 72, the cutting tool 22 is pushed forward (left in FIG. 2) out of the tool holder 14 and into the work piece. However, its average position within the tool holder 14 is determined by the hardness of the work piece being cut by the cutting tool. If the work piece is made from hard material, the cutting tool will penetrate the work piece to a lesser extent during each impact of cutting tool and therefore will rebound (to the right in FIG. 2) from the work piece to a greater extent after it has struck it. In this situation, the rib 102 will be located in close proximity to the body 90 of the tool holder 14 as shown in FIG. 4. If the work piece is made from soft material, the cutting tool 22 will penetrate the work piece to a greater extent during each impact of cutting tool 22 and therefore the cutting tool 22 will rebound from the work piece to a lesser extent after it has struck it. In this situation, the rib 102' will be located in close proximity to the U shaped bracket 18 of the pivotal clamp 16 (shown in dashed lines 102' as shown in FIG. 4).

During each impact cycle (i.e. the impact of the cutting tool followed by its rebound) by the cutting tool 22, whilst the position of the rib 102 will maintain an average position relative to the body 90 of the tool holder 22 (close to the body 90 of the tool holder 14 for hard material; close to the U shaped bracket 18 of the pivotal clamp 16 of the tool holder for soft material), the actual position of the rib 102 will move across a small range of positions whilst it is located at that average position during each impact cycle.

Figure 5A:
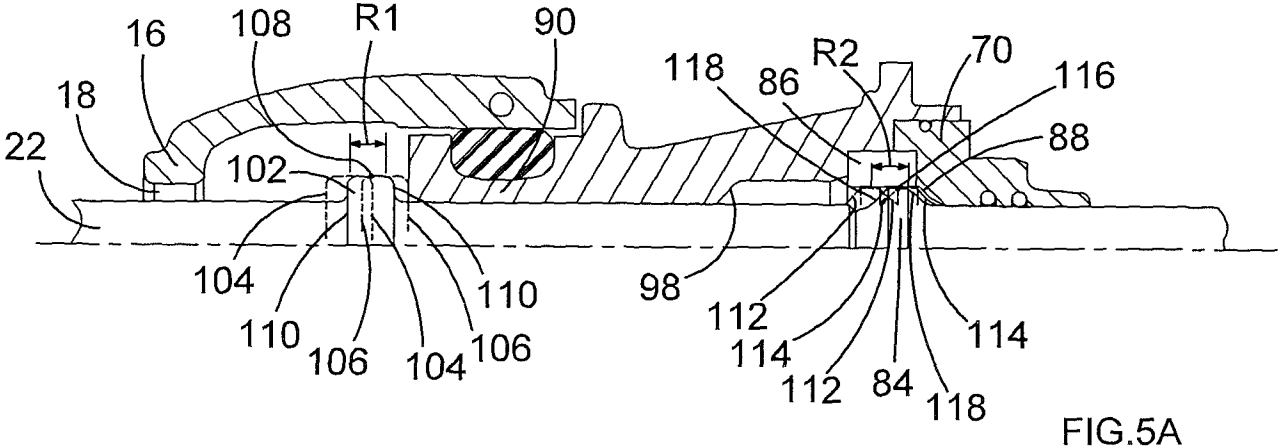
FIG. 5A which shows a diagram of part of the tool holder and beat piece in a second position when the cutting tool is cutting hard material.

Referring to FIG. 5A which shows the position of the cutting tool 22 and beat piece 72 when the cutting tool 2 is cutting a hard material, the average position of the rib 102 of the cutting tool 22 within the tool holder 14 is in close proximity to the body 90 of the tool holder 14. During each impact, the rib 102 will move axially during the impact and subsequent rebound (the impact cycle). The rib 102 will move between positions 104 and 106. The centre point 108 of the rib 102 will travel over the range of movement indicated by Arrow R1 as rib 102 moves between its two end positions 104, 106. However, the rib 102 will remain generally in close proximity to the body 90 of the tool holder 14 and is referred to as the average position 110.

Figure 5B:
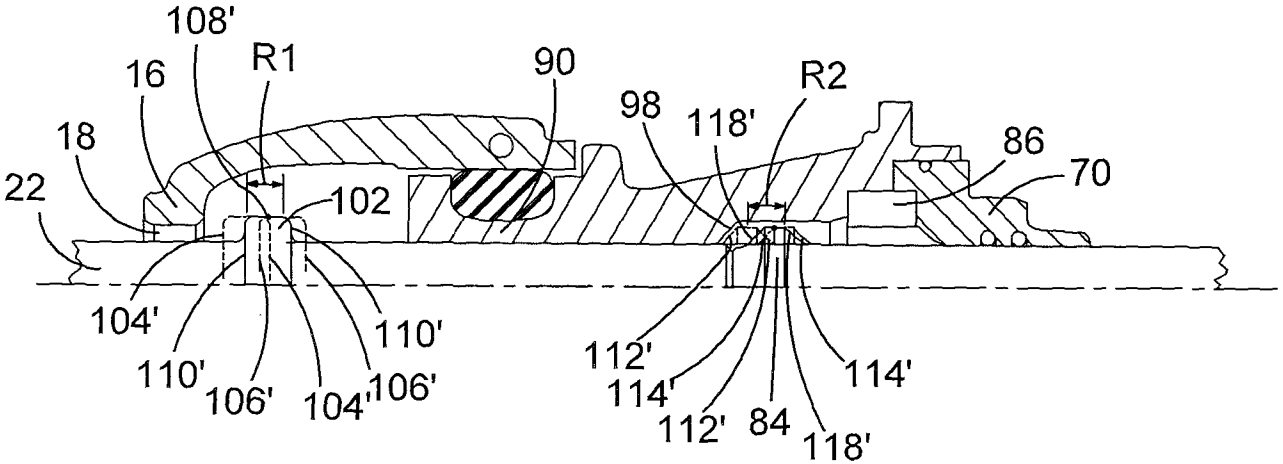
FIG. 5B which shows a diagram of part of the tool holder and beat piece in a first position when the cutting tool is cutting soft material.

Referring to FIG. 5B which shows the position of the cutting tool 22 and beat piece 72 when the cutting tool 22 is cutting a soft material, the average position of the rib 102' of the cutting tool 22 within the tool holder is in close proximity to the U shaped bracket 18 of the pivotal clamp 16 of the tool holder. During each impact cycle, the rib 102' will move axially during the impact and subsequent rebound. The rib 102' will move between positions 104' and 106'. The centre point 108' of the rib 102' will travel over the range of movement indicated by Arrow R1 as rib 102' moves between its two end positions 104', 106'. However, the rib 102' will remain generally in close proximity to the U shaped bracket 18 of the pivotal clamp 16 of the tool holder and is referred to as the average position 110'.

The average position of the cutting tool 22 within tool holder 14 effects the average position of the beat piece 72 within the beat piece support structure 70. When the cutting tool 22 is cutting hard material, the average position of the rib 102 is close to the body 90 of the tool holder 14 which in turn results in the beat piece 72 being moved to a position where the flange 84 is located in close proximity to the forward facing chamfer 88 formed within the beat piece support structure 70 as shown in FIG. 5A. When the cutting tool 22 is cutting soft material, the average position of the rib 102' is close to the to the U shaped bracket 18 of the pivotal clamp 16 of the tool holder 14 which in turn results in the beat piece 72 being moved to a position where the flange 84 is located in close proximity to the rearward facing chamfer 98 formed within the body 90 of the tool holder 14 as shown in FIG. 5B.

During each impact cycle, whilst the position of the flange 84 of the beat piece 72 will maintain an average position relative to the beat piece support structure 70, the actual position of the flange 84 will move across a range of positions whilst it is located at that average position during each impact cycle.

Referring to FIG. 5A, the average position of the flange 84 is in close proximity to the forward facing chamfer 88 within the beat piece support structure 70. During each impact cycle, the flange 84 will move axially during the impact and subsequent rebound. The flange 84 will move between positions 112 and 114. The centre point 116 of the flange 84 will travel over the small range of movement indicated by Arrow R2 as the flange 84 moves between its two end positions 112, 114. However, the flange 84 will remain generally in close proximity to the forward facing chamfer 88 within the beat piece structure 70 and is referred to as the average position 118.

Referring to FIG. 5B, the average position of the flange 84' is in close proximity to the rearward facing chamfer 98 within the body 90 of the tool holder 14. During each impact cycle, the flange 84' will move axially during the impact and subsequent rebound. The flange 84' will move between positions 112' and 114'. The centre point 116' of the flange 84' will travel over the range of movement indicated by Arrow R2 as the flange 84' moves between its two end positions 112', 114'. However, the flange 84' will remain generally in close proximity to the rearward facing chamfer 98 within the body 90 of the tool holder 14 and is referred to as the average position 118'.

Figure 3:
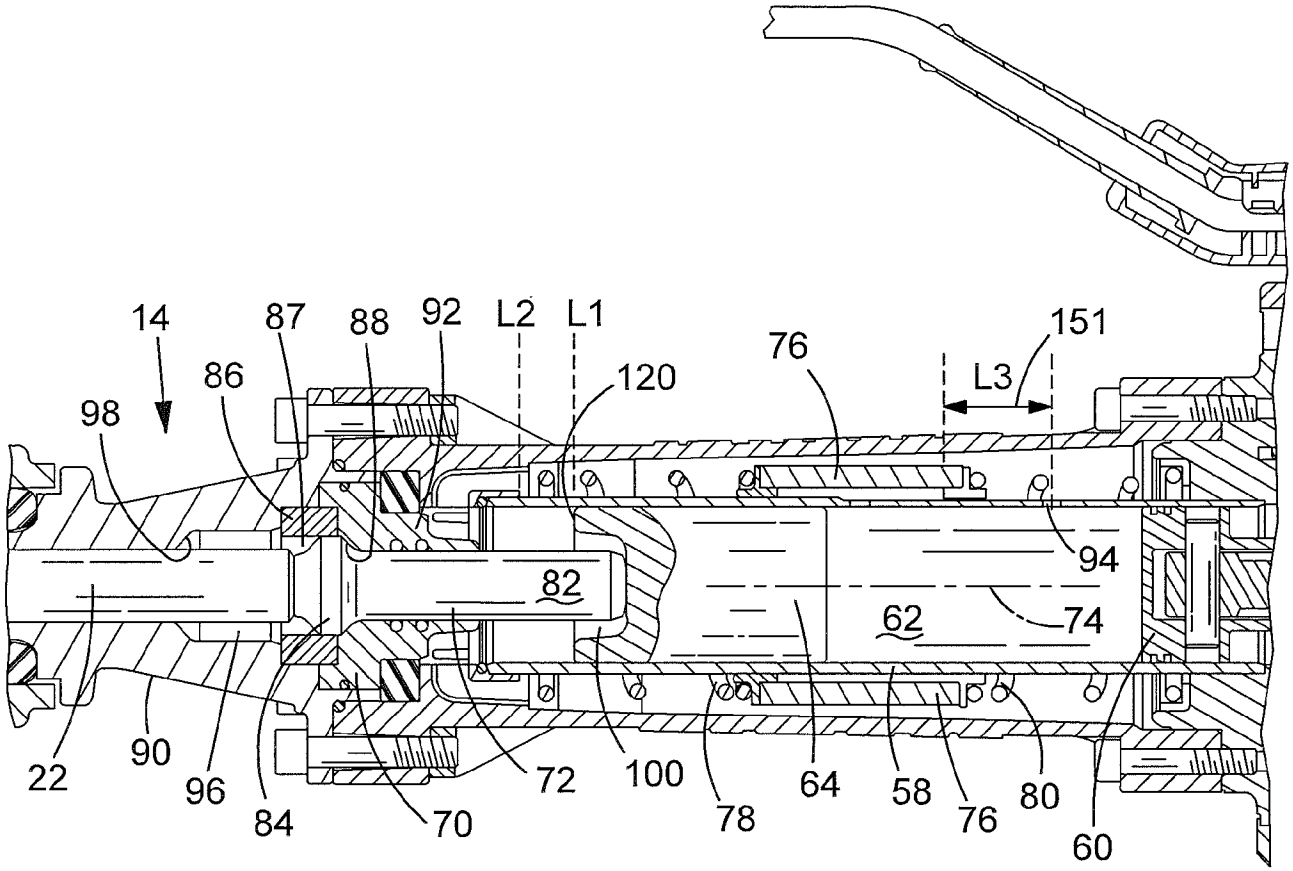
FIG. 3 shows an enlarged view of the middle part of the vertical cross section of the pavement breaker with the bleed hole in the first position as shown in FIG. 2.

The average position of the beat piece 72 within the beat piece support structure 70 effects the amount by which the ram 64 can slide within the cylinder 58 away from the piston 60. When the cutting tool 22 is cutting hard material, the average position of the beat piece 72 within the beat piece support structure 70 is such that the maximum forward position of the front 120 of the ram 64 away from the piston 60 is limited to the position indicated by L1 as shown in FIG. 3. When the cutting tool 22 is cutting soft material, the average position of beat piece 72 within the beat piece support structure 70 is such that the maximum forward position of the front 120 of the ram 64 away from the piston 60 is limited to the position as indicated by L2 as shown in FIG. 3, which is closer to the tool holder 14.

It will be appreciated by the reader that the characteristics of the performance of the pavement breaker will be effected by the type of material that is being work on as the internal average positions of the beat piece 72 and cutting tool 22 will alter together with the maximum amount of travel of the ram 64.

Figure 6:
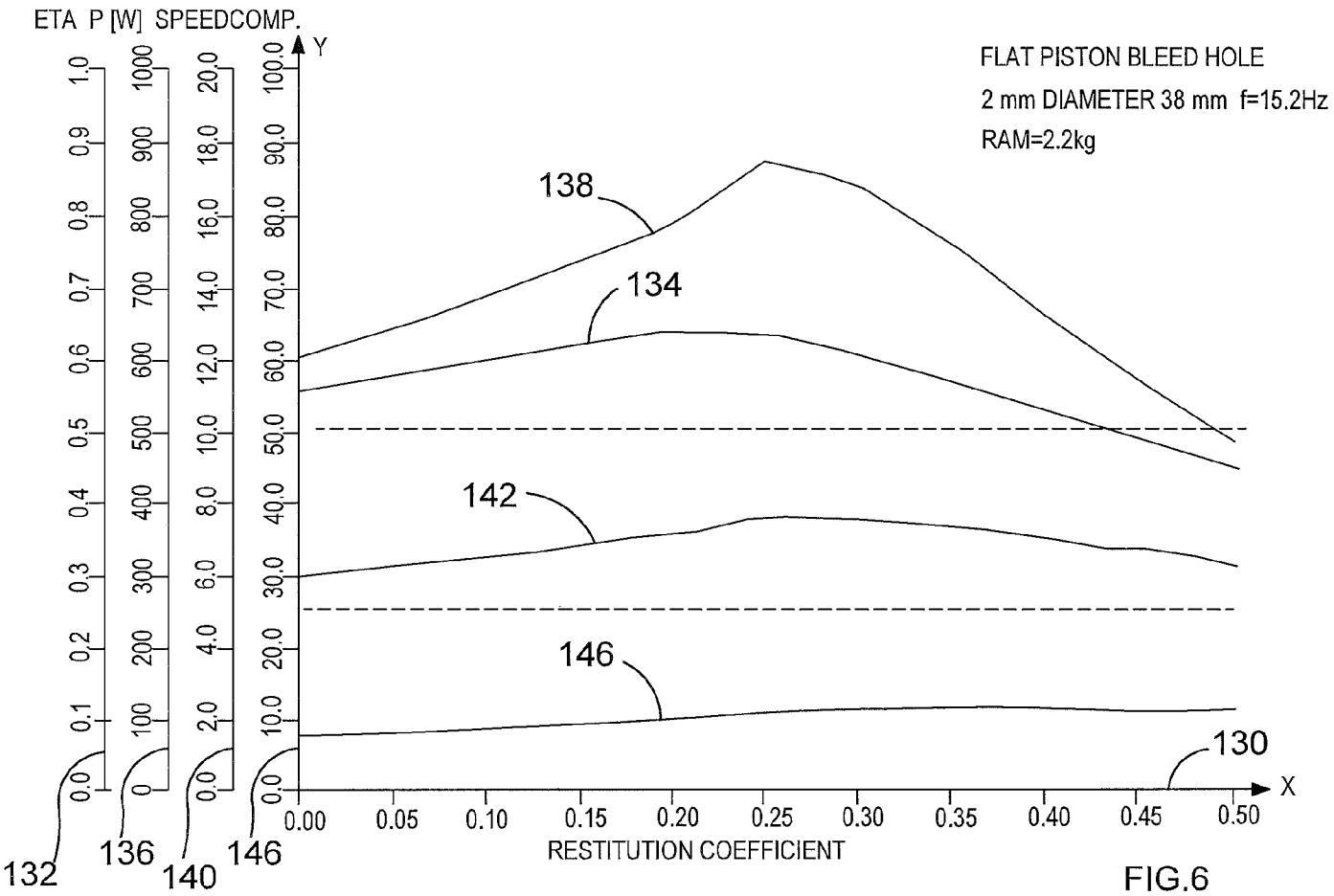
FIG. 6 shows a graph showing the properties of the pavement breaker of FIG. 2; dependent on the hardness of the material it is working.

FIG. 6 shows a graph showing the properties of the pavement breaker shown in FIG. 2 dependent on the hardness of the material it is working on. The piston is being reciprocatingly driven at 15.2 Hz by the motor.

The horizontal axis (X axis) 130 is the Restitution Coefficient and is an indicator of the harness of the material being work on. The Restitution coefficient is the return speed of the ram 64 (after it has impacted the material) divided by the impact speed of the ram (Restitution coefficient (RC)=return speed ram (V re)/speed ram (V) [m/s/m/s]). The harder the material, the faster the ram 64 will bounce back. For example, for a soft material such as lime stone, the Restitution Coefficient, Vre/V, is 2/20=0.1 (when the impact speed is 20 $ms^{-1}$). For a hard material, such as granite, the Restitution Coefficient, Vre/V is 10/20=0.5 (when the impact speed is 20 $ms^{-1}$). The higher the value of the Restitution Coefficient, the harder the material being worked on.

Four graphs are shown in FIG. 6, each having a different Y axis.

The first Y axis 132 is the ETA which ranges from 0 to 1.0. The ETA is the number of Watts of energy delivered by the ram to the cutting tool divided by the amount of energy in the connecting rod driving the piston. As such, it is a measure of the efficiency of the hammer mechanism. This varies depending on the hardness of the material being worked on and produces the graph 134 when the ETA is compared with the Restitution Coefficient.

The second Y axis 136 is power delivered by the hammer in Watts. This varies depending on the hardness of the material being worked on and produces the graph 138 when the power is compared with the Restitution Coefficient.

The third Y axis 140 is the impact speed of the ram in meters per second. This varies depending on the hardness of the material being worked on and produces the graph 142 when the impact speed is compared with the Restitution Coefficient.

The fourth Y axis 144 is the amount of compression of the air spring 62 in cylinder 58. The amount of compression is determined by the maximum air pressure of the air spring 62 divided by the pressure of the atmosphere. This varies depending on the hardness of the material being worked on and produces the graph 146 when the amount of compression is compared with the Restitution Coefficient.

Figure 7:
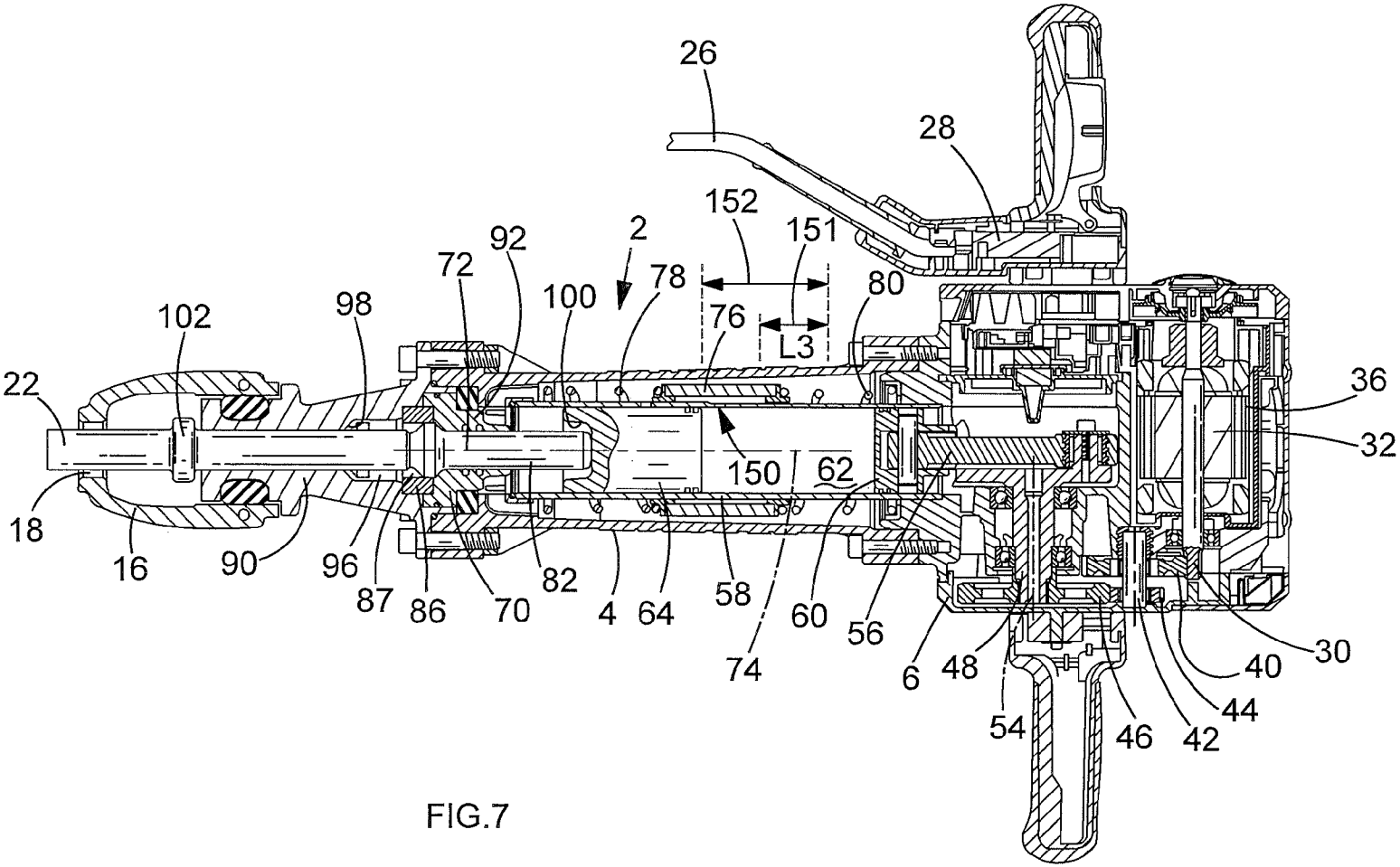
FIG. 7 shows a vertical cross section of a pavement breaker with the bleed hole in a second position.

The characteristics of the performance of the pavement breaker are effected by the size and axial location of the bleed hole 94 in the cylinder 58 relative to the piston 60. FIG. 7 shows a second design of pavement breaker which is identical to that shown in FIG. 2 except that the size and axial position of the bleed hole 150 has been altered. Where the same features are present in the second design shown in FIG. 7 are present in the first design as shown in FIG. 2, the same reference numbers have been used. The bleed hole 150 is a circular in cross section and 4 mm in diameter and has been located 152 further forward (80 mm) of the bleed hole 150 shown in FIG. 2 and forward of the maximum amount L3 by which the piston 60 can slide within the cylinder 58 away from the motor. The larger diameter allows more air to pass through it. The ram 64 passes over the bleed hole 150 as it is reciprocatingly driven by the piston 60. As such, the ram 64 repeatedly opens and closes the bleed hole 150 when it forward of the bleed hole 150 or when it is covering the bleed hole respectively. This results in the timing of when the bleed hole 150 is open and closed within a hammer cycle being altered when compared to that disclosed in FIG. 2.

Figure 8:
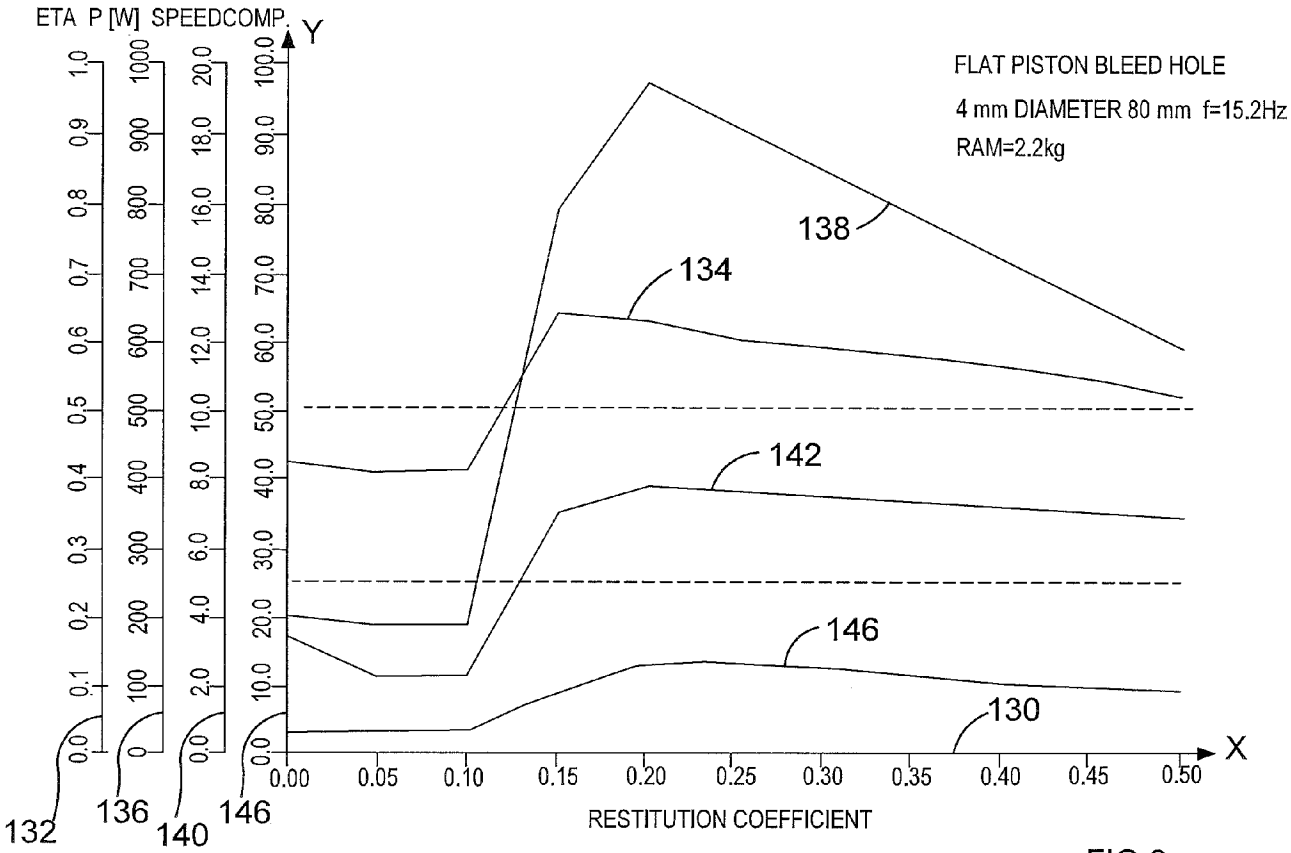
FIG. 8 shows a graph showing the properties of the pavement breaker of FIG. 7.

Again, it will be appreciated by the reader that the characteristics of the performance of this hammer will be effect by the type of material that is being work on. FIG. 8 shows a graph showing the properties of the pavement breaker shown in FIG. 7 dependent on the hardness of the material it is working on. The piston 60 is being reciprocatingly driven at 15.2 Hz by the motor. The same reference numbers for the Restitution Coefficient, ETA, impact speed, power and compression used in FIG. 6 have been used for the same features in FIG. 8.

As can be seen when comparing FIG. 6 with FIG. 8, when the bleed hole 150 is of the size and is located in the position shown in FIG. 7, the performance of the pavement breaker on hard material is greatly improved when compared to a bleed hole 94 of the size and position shown in FIG. 2. However, when the bleed hole 150 is of the size and is located in the position shown in FIG. 7, the performance of the hammer on soft material is reduced when compared to a bleed hole 94 of the size and position shown in FIG. 2.

A first embodiment of the present invention will now be described with reference to FIG. 9. The design of the embodiment is the same as the hammer described previously with reference to FIG. 2 except for the provision of two bleed holes 200, 202 and a switching mechanism for opening and closing the bleed holes 200, 202 depending on the average position of the beat piece 72 within the beat piece support structure 70. Where the same features are present in the first embodiment are present in the pavement breaker described with reference to FIG. 2, the same reference numbers have used. Please note the vibration dampener is not shown in FIG. 9 to aid clarity.

Figure 9:
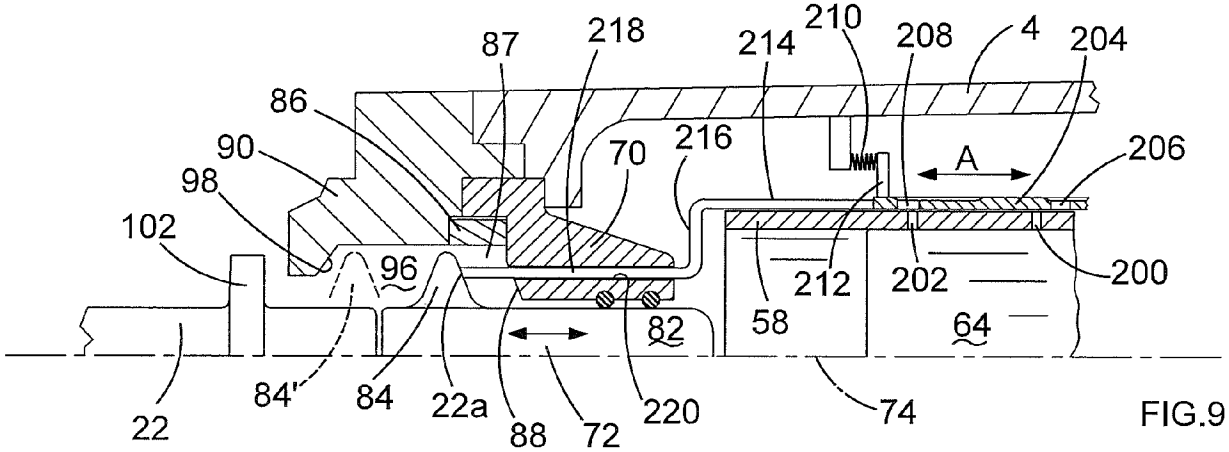
FIG. 9 shows a first embodiment of the present invention.

Referring to FIG. 9, the cylinder comprises two bleed holes 200, 202 formed through the side of the cylinder 58. The position and size of the first bleed hole 200 is the same as the bleed hole shown in FIG. 2. The position and size of the second bleed hole 202 is the same as the bleed hole shown in FIG. 7. Surrounding the cylinder is a sleeve 204 having two apertures 206, 208 formed through it. The sleeve 204 is cable of axially sliding along the cylinder 58 in a direction (Arrow A) parallel to the longitudinal axis 74 of the cylinder 58 but is prevented from rotating around the longitudinal axis 74. Each aperture 206, 208 is capable of aligning with a corresponding bleed hole 200, 202 on the cylinder 58. The length of each of the apertures 206, 208 (in a direction parallel to the longitudinal axis 74 of the cylinder 58) is greater then the diameter of its corresponding bleed hole 200, 202 enabling the each aperture 206, 208 to align with its corresponding bleed hole 200, 202 whilst the sleeve 204 is in a range of axial positions. The width (in a direction perpendicular to the longitudinal axis 74 of the cylinder 58) of each of the apertures 206, 208 is slightly greater than the diameter of the corresponding bleed hole 2002, 202. A lubricating grease is sandwiched between the cylinder 58 and the sleeve 204 to form an air tight seal between the two.

The positions of the apertures 206, 208 in a direction parallel to the longitudinal axis 74 of the cylinder 58 is greater than the distance between the bleed holes 200, 202 and is such that when one first aperture 206 is aligned with the first bleed hole 200, the second aperture 208 is located away form the second bleed hole 202, the sleeve 204 sealing the second bleed hole 202. As the sleeve 204 slides along the cylinder 58 away from the beat piece support structure 70, the first aperture 206 ceases to be aligned with the first bleed hole 200, the second aperture 208 becoming aligned with the second bleed hole 202. In this location, the sleeve 204 seals the first bleed hole 200. During the transition, the positions of the apertures 206, 208 on the sleeve 204 are such that both bleed holes 200, 202 can not be open at the same time. As such, only one bleed hole is open at any one time depending on the axial position of the sleeve 204 on the cylinder 58.

The amount of sliding movement of the sleeve 204 is limited so that the sleeve 204 can slide between two positions, a first position where the first aperture 206 is aligned with the first bleed hole 200, with the second bleed hole 202 being sealed by the sleeve 204, and a second position where the second aperture 208 is aligned with the second bleed hole 202, with the first bleed hole 200 being sealed by the sleeve 200.

A spring 210 is sandwiched between the housing 4 and a bar 212 attached to the sleeve 204 which urges the sleeve 204 forward towards its first position where it is closest to the beat piece support structure 70. Movement of the sleeve 204 from its first position to its second position, away from the beat piece support structure 70, is against the biasing force of the spring 210.

A rod having three sections 214, 216, 218 is attached to the sleeve 204. The third section 218 is located inside and capable of sliding within a passage 220 formed through the beat piece support structure 70. The end 222 of the rod projects in to the inner washer space 87 in which the flange 84 of the beat piece 72 can slide. The maximum amount by which the end 222 can project into the space 87 is limited by the middle section 216 of the rod abutting against the rear of the beat piece support structure 70 under the biasing force of the spring 210. When the end 22 of the rod extends by its maximum amount into the inner washer space 87, the sleeve 204 is in its first position.

When the pavement breaker is working on a soft material, the beat piece 72 is located in its forward average position. The flange 84' (indicated by dashed lines in FIG. 9) of the beat piece 72 is in front of the end 222 of the rod and makes no contact with the rod. As such, the end 22 of the rod is allowed to extend by its maximum amount into the space 87. When the rod is in this position, the sleeve 204 is located in its first position. In this position, the first aperture 206 is in alignment with the first bleed hole 200 allowing the first bleed hole 200 to be functional. The second aperture 208 is located forward of the second bleed hole 202 and as such, the second bleed hole 202 is sealed closed by sleeve 204. As such, only the first bleed hole 200 is operational. This results in an improved performance of the pavement breaker for soft material as the pavement breaker will have the performance characteristics shown in FIG. 6.

When the hammer is working on a hard material, the beat piece 72 is located in its rearward average position (indicated by solid lines in FIG. 9). In this position, the flange 84 of the beat piece 72 is located adjacent the forward facing chamfer 88 formed in the beat piece support structure 70 and engaged with the end 222 of the rod which is pushed rearward by the flange 84. When the rod is in this position, the sleeve 204 is pushed to its second rearward position by the rod. In this position, the second aperture 208 is in alignment with the second bleed hole 202 allowing the second bleed hole 202 to be functional. The first aperture 206 is located rearward of the first bleed hole 200 and as such, the first bleed hole 200 is sealed closed by the sleeve 204. As such, only the second bleed hole 202 is operational. This results in an improved performance of the pavement breaker for hard material as the pavement breaker will have the performance characteristics shown in FIG. 8.

During each impact cycle, the flange 84 moves axially over a small range of movement during the impact and subsequent rebound. When the flange 84 is in its rearward position in engagement with the end 222 of the rod, this small range of movement will be transferred to the rod which in turn will be transferred to the sleeve 204. This movement is accommodated by the fact that the length of the first aperture 206 (in a direction parallel to the longitudinal axis 74 of the cylinder 58) is not only greater then the diameter of the first bleed hole 200, but is sufficiently greater than small range of axial movement of the sleeve to enable the aperture 206 to remain aligned with the first bleed hole 200 whilst the sleeve 204 moves over the small range of axial positions.

It will be appreciated by the reader that a dampener could be added to limit the movement of the sleeve 2004 caused by the limited movement of flange 84 over the impact cycle, the sleeve 204 only moving in response to the movement of the average position of the flange 84.

A second embodiment of the present invention will now be described with reference to FIG. 10. The design of the second embodiment is the same as the first embodiment except that the mechanism comprising the rod 214, 216, 218 for moving the sleeve 204 in response to the position of the beat piece 72 within the beat piece support structure 70 has been replaced by a manual switching mechanism. Where the same features are present in the second embodiment are present in the first embodiment, the same reference numbers have used. Please note the vibration dampener is not shown in FIG. 10 to aid clarity.

Figure 10:
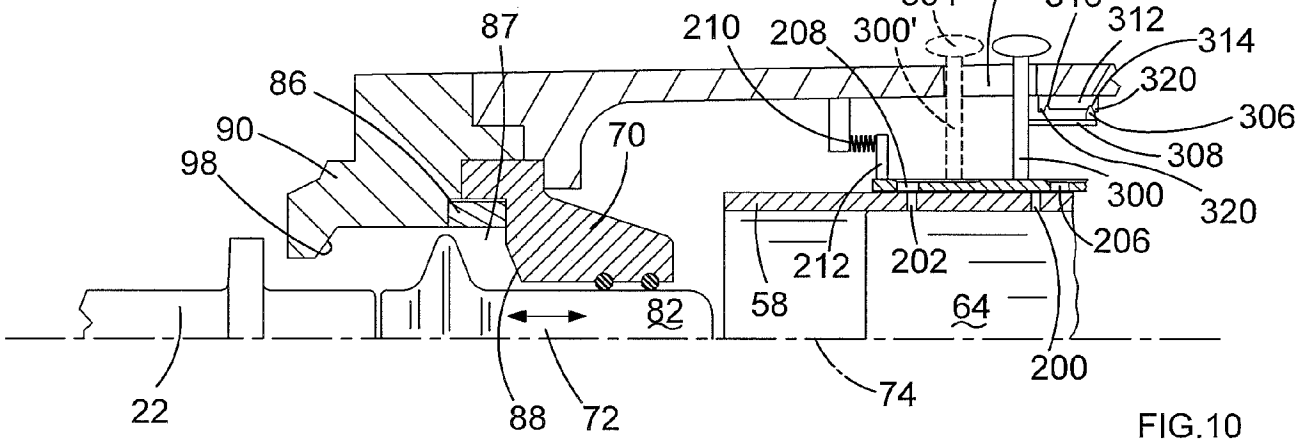
FIG. 10 shows a second embodiment of the present invention.
Figure 11A:
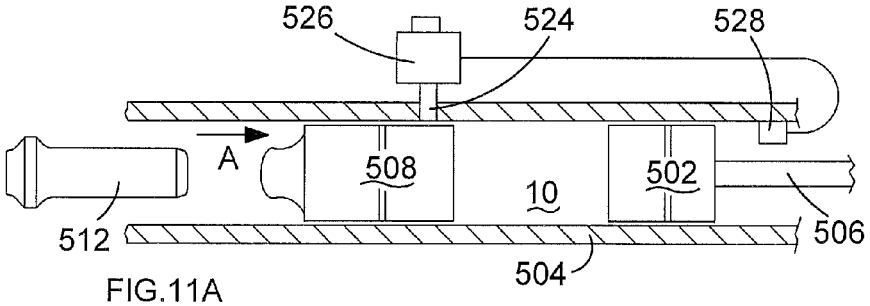
FIGS. 11A to 11D show sketches of a hammer having a single bleed hole with a valve according to a third embodiment.
Figure 11B:
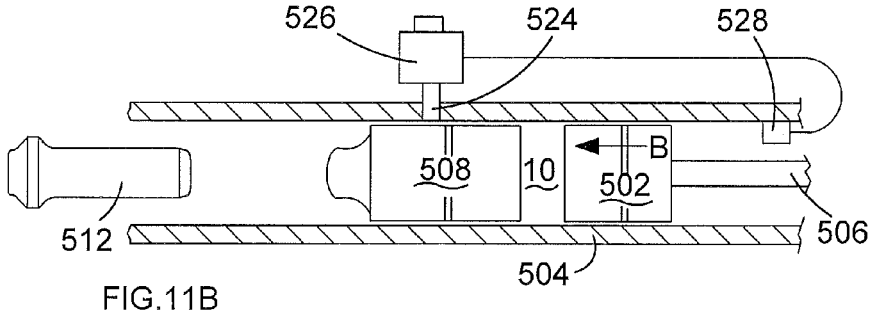
Figure 11C:
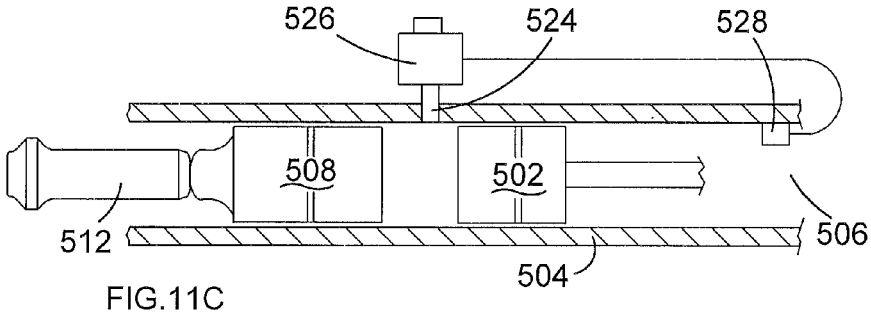
Figure 11D:
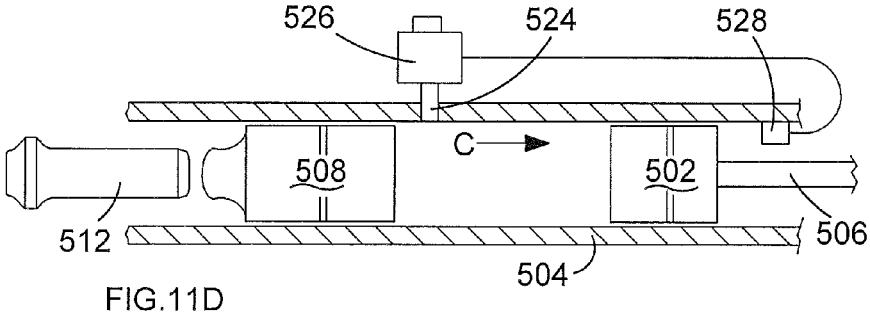

Referring to FIG. 10, the slideable sleeve 204 with the apertures 206, 208 function in the same manner as in the first embodiment to open and close the two bleed holes 200, 202. However, the use of the rod 214, 216, 218 has been removed and replaced with a manual switch. The manual switch comprises a rigid arm 300 attached to the sleeve 204 and which extends from the sleeve 204 in a direction perpendicular to the longitudinal axis 74 of the cylinder 58 from the sleeve 204 and through an aperture 302 formed through the wall of the middle housing 4. Attached to the end of the arm 300 is a finger pad 304 which can be engaged by an operator. A catch comprising a rib 306 mounted on the end of a leaf spring 308 which is attached to and extends side ways from the arm 300 is biased towards a slide pad 312 which comprises two notches 314, 316. An operator can engage the finger pad 304 and slide it (Arrow A) between a first position (shown in dashed lines) where the rib 306 engages the first notch 316 to a second position (shown in solid lines) where it engages the second notch 314, or vice versa. The sliding movement of the finger pad results in a corresponding sliding movement of the sleeve 204. In the first position, the first aperture 206 of the sleeve 204 is in alignment with the first bleed hole 200, with the second bleed hole 202 sealed by the sleeve 204. In the second position, the second aperture 208 of the sleeve 204 is in alignment with the second bleed hole 202, with the first bleed hole 200 sealed by the sleeve 204.

The range of movement of the finger pad 304 is limited by the end stops 320 limiting the range of movement of the rib 306.

When an operator knows that he is going to use the pavement breaker on a soft material such as limestone, he slides the finger pad 304 to its first position so that only the first bleed hole 200 is operative. When an operator knows that he is going to use the pavement breaker on a hard material such as limestone, he slides the finger pad 304 to its second position so that only the second bleed hole 200 is operative.

The spring 210 biases the finger pad 304 to its first position where the performance characteristics of the pavement breaker are more uniform when used on materials with a range of hardness. However, the leaf spring 308 has sufficient strength to hold the rib 306 within the second notch 314 against the biasing force of the spring 210 when it is moved to this position.

Whilst the embodiments described above relate to a pavement breaker, it will be appreciated by the reader that the invention can be utilized on any type of hammer drill having a cylinder, inside of which is a piston and ram, where the reciprocating movement of the piston reciprocatingly drives the ram via an air spring.

A third embodiment will now be described with reference to FIGS. 11A to 11D. The third embodiment is similar to the previous embodiments except that the two bleed holes in the previous embodiments have been replaced with a single bleed hole and a valve. FIGS. 11A to 11D show a schematic diagram of a hammer comprising a cylinder 504, a piston 502 slidingly mounted within the cylinder 504 which is reciprocatingly driven by a con rod 506 within the cylinder. A ram 508 is mounted within the cylinder and is reciprocatingly driven by the piston 502 via an air spring 510. The ram 508 repetitively strikes a beat piece 512 which in turn strikes a cutting tool held in the tool holder. A single bleed hole 524 is formed through the wall of the cylinder 504 for proving air to replenish the air spring 510. A valve 526 controls the timing and volume of the air flow through the bleed hole. FIGS. 11A to 11D show the positions of the component parts of the hammer mechanism over the course of a hammer cycle.

The valve 526 is opened and closed electronically. The timing of the opening and closing of the valve 526 is related to the position of the piston which is measured using a sensor 528 which produces a signal for use by the valve which is indicative of the position of the piston. By controlling when the valve is opened and closed versus the position of the piston 502, it is possible to mimic the position of the bleed holes shown in the previous embodiments. Furthermore, by controlling the volume of the air which passes through the bleed hole 524, it can also mimic the sizes of the bleed holes in the previous embodiments. The determination of the timing of the opening and closing of the valve relative to the piston position and volume can be preset by an operator dependent on the hardness of the material the hammer is intended to be used upon, or by sensing the position of the beat piece 512, which is dependent on the position of the cutting tool, which in turn is dependent on the hardness of the material the hammer is working on, in a similar manner as described in the first embodiment.

Figure 12:
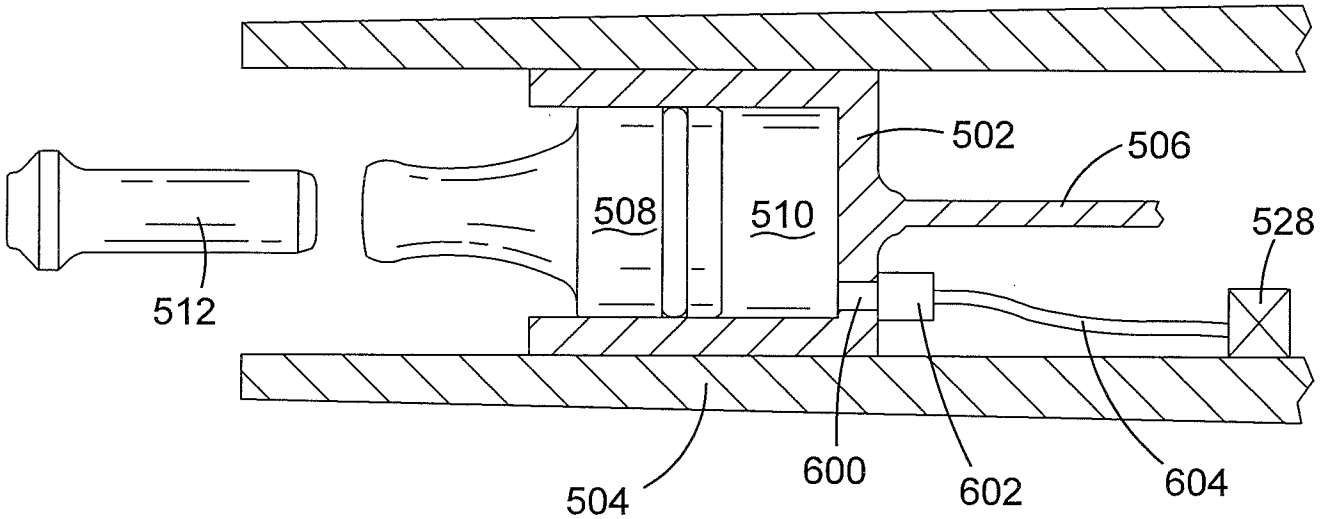
FIG. 12 shows a schematic view of a fourth embodiment with a hollow piston.

A fourth embodiment is shown in FIG. 12. The fourth embodiment is similar to the third except for the fact that the piston 502 is a hollow piston, the ram 508 being slidingly mounted within the piston, the air spring 510 being located between the ram 508 and the piston 502.

A bleed hole 600 is formed through the end of the piston 502 to connect between the air spring 510 and the surrounding atmosphere. A valve 602 is attached to the bleed hole 600. A cable 604 attaches between the valve 602 and the sensor 528. The timing of the air flow and the amount of air allowed to pass through the bleed hole 600 can be controlled by the valve 602 in the same manner as the third embodiment.

The invention claimed is:

1. A hammer drill comprising:

a body;

a cylinder mounted within the body;

a motor mounted within the body having an output spindle;

a tool holder mounted on the body, the tool holder being capable of holding a cutting tool;

a hammer mechanism comprising:

a piston slideably mounted within the cylinder;

a reciprocating drive mechanism mounted within the body which, when the motor is activated, converts the rotary movement of the spindle of the motor into a reciprocating movement of the piston within the body;

a ram slideably mounted within the cylinder forward of the piston, the ram being reciprocatingly driven by the reciprocating movement of the piston via an air spring to repetitively strike a cutting tool when held by the tool holder, the hammer mechanism performing one hammer cycle each time the ram strikes a cutting tool during normal use;

an air replenishment mechanism which is capable of refreshing the air spring during certain time periods within the hammer cycle during normal use;

characterized in that the air replenishment mechanism is capable of being adjusted so that it refreshes the air spring during different time periods within the hammer cycle during normal use and/or it allows different the volumes of air allows into or out of the air spring during the refreshment time periods, wherein the air replacement mechanism comprises a bleed hole formed through the wall of the cylinder and a valve connected to the bleed hole which, during the hammer cycle, selectively opens and closes the air bleed hole to allow air to pass through it during certain time periods within the hammer cycle and/or controls the volume of air passing through the bleed hole when it is open.

2. A hammer drill as claimed in claim 1, wherein there is provided a cylinder mounted within the body, the piston and ram being slideably mounted within the cylinder, the ram being mounted within the cylinder forward of the piston;

wherein the air replenishment mechanism comprises:

at least two bleed holes formed through the wall of the cylinder in different axial positions along the length of the cylinder;

a selector mechanism which selectively opens and closes the bleed holes, the selector mechanism only opening one bleed hole at any one time.

3. A hammer drill as claimed in claim 2, wherein the dimensions of the at least two bleed holes are different relative to each other.

4. A hammer drill as claimed in claim 2, wherein the selector mechanism comprises a sleeve mounted in an axially slideable manner on the cylinder and which comprises at least two apertures, one of which is capable of being selectively aligned with one of the bleed holes at any one time as the sleeve is axially slid along the cylinder, the sleeve closing the remaining bleed holes.

5. A hammer drill as claimed in claim 1, wherein there is provided a sensor for providing a signal which is an indication of the position of the piston and which is used to control the opening and closing of the valve.

6. A hammer drill as claimed in claim 1, wherein the bleed holes are further opened and closed using the piston and/or ram.

7. A hammer drill as claimed in claim 1, wherein the selector mechanism is operated manually to operate the air replenishment mechanism.

8. A hammer drill comprising:

a body;

a motor mounted within the body having an output spindle;

a tool holder mounted on the body, the tool holder being capable of holding a cutting tool;

a hammer mechanism comprising:

a piston slideably mounted within the body;

a reciprocating drive mechanism mounted within the body which, when the motor is activated, converts the rotary movement of the spindle of the motor into a reciprocating movement of the piston within the body;

a ram slideably mounted within the body which is reciprocatingly driven by the reciprocating movement of the piston via an air spring to repetitively strike a cutting tool when held by the tool holder, the hammer mechanism performing one hammer cycle each time the ram strikes a cutting tool during normal use;

an air replenishment mechanism which is capable of refreshing the air spring during certain time periods within the hammer cycle during normal use;

characterized in that the air replenishment mechanism is capable of being adjusted so that it refreshes the air spring during different time periods within the hammer cycle during normal use and/or it allows different volumes of air allows into or out of the air spring during the refreshment time periods;

wherein the piston is a hollow piston, the ram being slideably mounted within the piston;

wherein the air replacement mechanism comprises a bleed hole formed through the wall of the piston and a valve connected to the bleed hole which, during the hammer cycle, selectively opens and closes the air bleed hole to allow air to pass through it during certain time periods within the hammer cycle and/or controls the volume of air passing through the bleed hole when it is open.

9. A hammer drill comprising:

a body;

a motor mounted within the body having an output spindle;

a tool holder mounted on the body, the tool holder being capable of holding a cutting tool;

a hammer mechanism comprising:

a piston slideably mounted within the body;

a reciprocating drive mechanism mounted within the body which, when the motor is activated, converts the rotary movement of the spindle of the motor into a reciprocating movement of the piston within the body;

a ram slideably mounted within the body which is reciprocatingly driven by the reciprocating movement of the piston via an air spring to repetitively strike a cutting tool when held by the tool holder, the hammer mechanism performing one hammer cycle each time the ram strikes a cutting tool during normal use;

an air replenishment mechanism which is capable of refreshing the air spring during certain time periods within the hammer cycle during normal use;

characterized in that the air replenishment mechanism is capable of being adjusted so that it refreshes the air spring during different time periods within the hammer cycle during normal use and/or it allows different volumes of air allows into or out of the air spring refreshment time periods;

wherein the tool holder is capable of holding a cutting tool in a range of axial positions, the average axial position of the cutting tool within the tool holder during use being dependant on the hardness of the material being cut by the cutting tool;

wherein there is further provided:

a detection mechanism which determines the position of a cutting tool within the tool holder and provides an indication of the cutting tools position; and the air replenishment mechanism, in response to indication of the detection mechanism, is adjusted so that it refreshes the air spring during different time periods within the hammer cycle and/or it allows different the volumes of air allows into or out of the air spring during the refreshment time periods dependent on the position of the cutting tool.

10. A hammer drill as claimed in claim 9, wherein the detection mechanism determines the average position of the cutting tool.

11. A hammer drill as claimed in claim 9, wherein there is further provided:

a beat support structure mounted within the housing;

a beat piece slideably mounted within the beat piece support structure, wherein the ram strikes a cutting tool via the beat piece, the detection mechanism determining the position of a cutting tool within the tool holder by determining the position of the beat piece within the beat piece support structure.

12. A hammer drill as claimed in claim 11, wherein the detection mechanism determines the average position of the beat piece.

13. A hammer drill as claimed in claim 11, wherein the beat piece comprises a flange, and wherein the detection mechanism determines the position of the flange.

14. A hammer drill as claimed in claim 13, wherein the detection mechanism comprises a rod which is biased towards and capable of engaging with the flange.

15. A hammer drill as claimed in claim 9, wherein the valve is open and closed dependent on the position of the piston and the position of the cutting tool.

* * * * *